United States Patent [19]

Benedick

[11] 4,248,841

[45] Feb. 3, 1981

[54] ANTI-LEAK VALVE FLUSHING SYSTEM FOR THERMAL REGENERATION APPARATUS

[75] Inventor: Edward H. Benedick, Morristown, N.J.

[73] Assignee: Regenerative Environmental Equipment Co., Inc., Morris Plains, N.J.

[21] Appl. No.: 60,668

[22] Filed: Jul. 25, 1979

[51] Int. Cl.[3] ..... F01N 3/10; F01N 3/26; F23C 6/04; F23G 7/06

[52] U.S. Cl. ..... 423/210; 110/204; 110/210; 422/168; 422/175; 431/5; 431/202

[58] Field of Search ..... 422/169, 170, 171, 173, 422/175, 177, 178, 181, 168; 423/210 C; 431/5, 29, 202; 110/204, 210

[56] References Cited

U.S. PATENT DOCUMENTS

| | | | |
|---|---|---|---|
| 3,870,474 | 3/1975 | Houston | 422/178 X |
| 3,895,918 | 7/1975 | Mueller | 422/175 |
| 4,036,576 | 7/1977 | McCracken | 431/5 |
| 4,124,696 | 11/1978 | Kunkel | 422/169 X |

*Primary Examiner*—Joseph Scovronek
*Attorney, Agent, or Firm*—Nelson E. Kimmelman

[57] ABSTRACT

In thermal regeneration incineration apparatus having a main combustion chamber in communication with at least one heat-exchange section to which inlet and outlet ducts are connected, each duct having an associated valve, purified effluent from the output of the apparatus is fed back to blanket at least one side of one or both of the valves. This helps to prevent unpurified effluent applied to the input of the apparatus from leaking through the valves when nominally closed and thereby avoiding passage through the main combustion chamber.

12 Claims, 2 Drawing Figures

ANTI-LEAK VALVE FLUSHING SYSTEM FOR THERMAL REGENERATION APPARATUS

BACKGROUND OF INVENTION

A. Field of the Invention

This invention relates to thermal regeneration systems for anti-pollution purposes and in particular to apparatus and a method for reducing the flow of unpurified industrial or commercial effluent into the atmosphere.

B. Prior Art

Thermal regeneration apparatus is known such as shown in the U.S. Pat. No. 3,895,918 issued to James H. Mueller on July 22, 1975. In that system, a number of heat-exchange sections are arranged about and in communication with a central, high temperature chamber. Each heat-exchange section includes a heat-exchange bed with a large number of refractory elements or "stones" confined within a heat-exchange bed by inward and outward perforated retaining walls. An industrial effluent to be purified is applied to an inlet duct ring which has branch ducts that distribute the effluent to selected ones of the heat-exchange sections whenever its associated inlet valve is open. In such a case, the effluent traverses the heat-exchange bed which has a temperature gradient from the front inner retaining wall to the rear outer retaining wall. The front inner wall and region are hotter than the regions located more toward the outside since the front is closer to the very high temperature central combustion or incineration chamber.

All of the heat-exchange sections are also coupled by branch conduits to an exhaust duct ring, the ring itself being connected to an exhaust fan that draws the gaseous contents of the exhaust ring out and applies them to an exhaust stack or equivalent.

The effluent initially traverses a first heat-exchange bed in one of the inlet heat exchange sections after passing through an open inlet valve (the outlet valve of that section being kept closed) and then is drawn through the central combustion chamber where it is purified by high temperature oxidation. It is then drawn through at least a second heat-exchange bed to whose stones the purified combustion products lose their very high heat. In the second heat exchange section, the inlet valve remains closed whereas the outlet valve is open.

When the next cycle begins, however, a second heat-exchange section may be caused to operate as an inlet heat exchanger, whereas the first inlet heat-exchange section may have its role reversed to function as an outlet heat exchanger. Thus, in the next cycle, the first heat exchange section will have its outlet valve turned off and its inlet valve opened whereas the second inlet heat exchange section will have just the opposite valve condition. Before the next cycle begins, however, there is an intermediate period in which both valves of the first section will be turned off so that any residual effluent in that section may be drawn off by the suction generated by the exhaust fan. Otherwise, when the next cycle begins and the condition of the valves in the first section are reversed, this residual unpurified effluent might be drawn directly into the outlet exhaust ring without having traversed the heat-exchange bed in the first section, the central combustion chamber and the heat-exchange bed in the second heat-exchange section.

This would result in the emission of noxious or dangerous gases into the atmosphere.

The valves used at the inlet and outlet of the respective heat-exchange sections are often metal-to-metal because of the temperatures involved. Even if the valves are nominally closed, imperfections in manufacture of the valves or defects in them induced by heat or by other operating causes may result in leaks of the effluent through the inlet and outlet valves, especially when there is a changeover of a heat-exchange section from an inlet to an outlet mode so that the effluent flows directly in the outlet exhaust ring thereby bypassing the thermal oxidation process.

Although there is a problem with valves such as these insofar as leakage is concerned, there is no practical way to measure such leakage once it has been installed in the apparatus as shown. While an individual valve can have its leakage measured on a test stand using ambient air, the latter is so much lower than actual operating gas temperatures that such tests are not too valid. To simulate actual operating temperatures would require elaborate heat exchange equipment and other expensive equipment. Furthermore, because of shop machining practices and allowable tolerances, no two valves which are supposed to be the same have the same leakage rate. While it may be that the leakage is less than 1%, even that small amount may be intolerable in certain areas where antipollution measures are stringently enforced.

Several ways of combating this leakage have been proposed among which is a plan whereby double valves in series are used at the inlet and outlet valves so as to reduce the pressure differential across each valve and thereby the rate and volume of leakage. This proposal is made in the co-pending application Ser. No. 052,670, filed June 27, 1979 entitled "Double Valve Anti-Leak System for Thermal Regeneration Incinerators." This method may be further improved, as explained in that application, by applying some of the purified exhaust gas under pressure to the space between each pair of series valves. While this is an effective method to prevent leakage, it does require the use of a double number of valves and appurtenant controls.

It is therefore among the objects of the present invention to:

(1) provide a system for preventing leakage of effluent across valves in incineration systems.

(2) provide an anti-leak system for incineration apparatus which does not require the use of double valves and the concomitant instrumentation for them.

SUMMARY OF THE INVENTION

Purified effluent in the exhaust of a thermal regeneration apparatus is fed back to blanket at least one side of valves located in the inlet and/or outlet duct which communicates with each heat-exchange section of the apparatus to prevent unpurified effluent from leaking through the valve(s) when nominally closed thereby avoiding passage through the main incineration chamber of the apparatus.

DETAILED DESCRIPTION OF THE DRAWINGS

Figure 1:
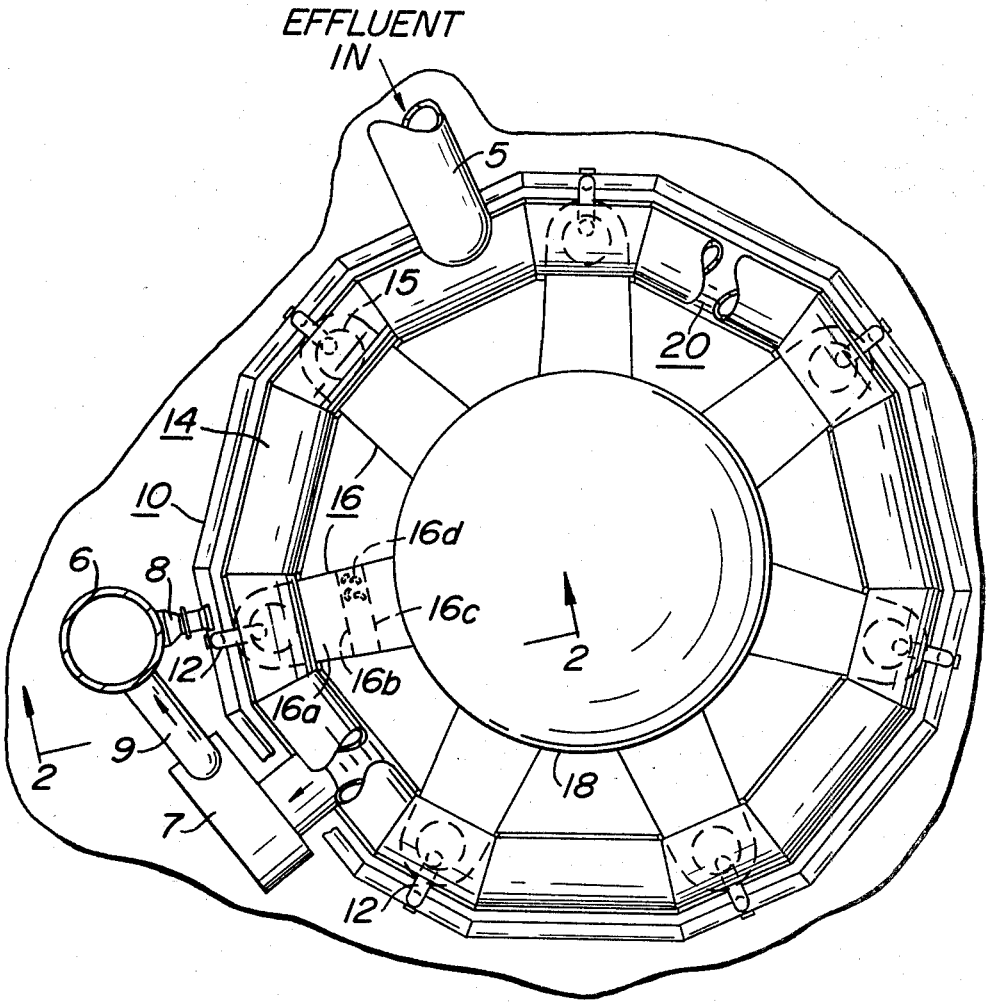
FIg. 1 is a plan view of apparatus constructed in accordance with the present invention.
Figure 2:
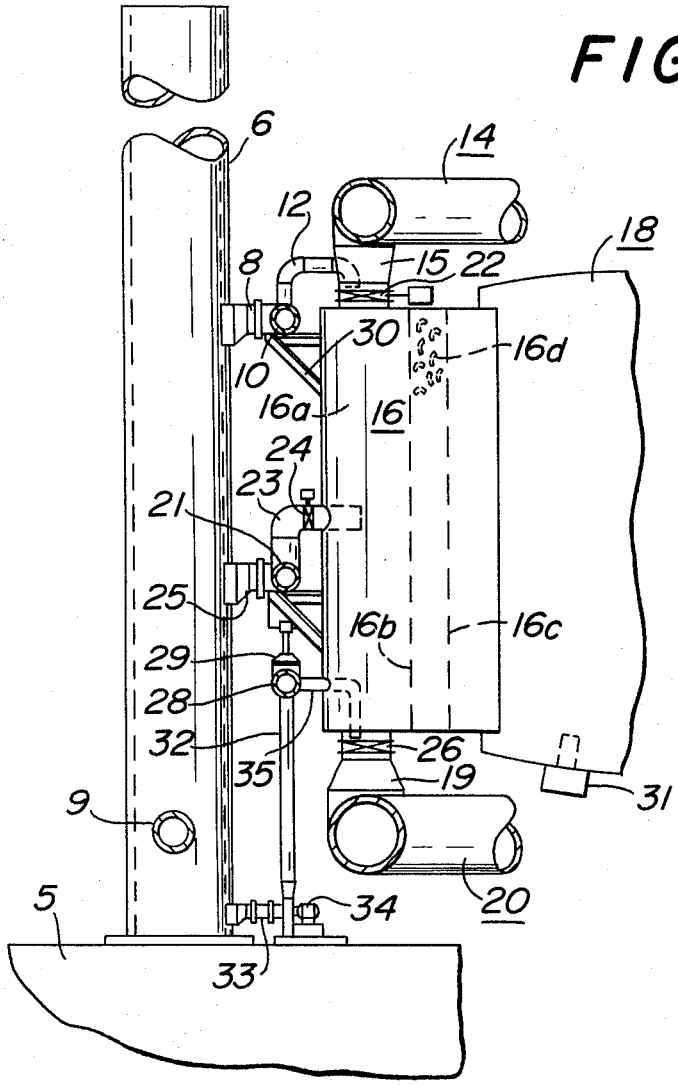
FIG. 2 is a fragmentary, and sectional view of the apparatus shown in FIG. 1 taken along section line 2—2 in the direction indicated.

A thermal regeneration system is shown in the figures in which there are a number of heat-exchange sections 16 arranged equiangularly around, and in communication with, a central combustion zone 18 having a burner 31 therein. Each of the heat-exchange sections 16 has a bed of heat-exchanging ceramic elements 16*d* retained by vertical perforated walls 16*b* and 16*c*. An industrial effluent to be incinerated is applied via an inlet duct (shown at 5) to an upper duct ring 14 to which vertical ducts 15 are coupled that convey the effluent to each of the sections 16 into flue chambers 16*a* outwardly of the retaining wall 16*b*. There is a corresponding outlet or exhaust ring 20 located below the upper ring 14, the exhaust ring being coupled to an exhaust fan (shown at 7). The negative pressure produced within the ring 20 causes the effluent to be sucked in from ring 14 through one or more of the heat-exchange sections 16, through the associated heat-exchange elements 16*d* into the high-heat combustion chamber 18 and then out through a different one of the sections 16 to the exhaust 20 via duct 19. Of course, in order to follow the trajectory described above, it is necessary to operate certain valves on the inlet and outlet of the various sections 16. Thus, when it is desired to have the effluent pass through the section 16 illustrated in FIG. 2, the valve 22 is opened whereas the valve 26 is closed. At the same time, in another section 16, the inlet valve is closed and the outlet valve is open. The stack 6 is coupled to the exhaust fan for discharge into the ambient air.

As explained above, the system thus far is of conventional construction and in general accordance with the teachings of the aforementioned Mueller patent. In accordance with the present invention, there is another duct ring 10 provided outwardly of the sections 16 having pipes 12 communicating with it and with the downward ducts 15 as shown so that its free end is just above each of the inlet valves 22. This ring may be considerably smaller than the inlet duct 14 and communicates by way of duct 8 with the exhaust stack 6. Ordinarily, because of the action of the exhaust fan throughout the system, there will be a negative pressure just above the inlet valves 22 say, on the order of −2.5 inches (water). This suction will be sufficient to draw from the stack 6 a certain portion of the purified exhaust air which applies it in blanketing fashion above the valve 22 when it is closed. Thus, this purified and warm air constantly occupies the space just above the valve 22 so that if the negative pressure induced in the vertical duct 15 by the exhaust system is able to pull gases through the valve 22 even when closed, it is the purified exhaust air which will enter the section 16 outwardly of the wall 16*b*, not the unpurified effluent in ring 14. Therefore, when the inlet valve is supposed to be closed, no effluent will proceed from the inlet ring to the sections 16 and down into the exhaust ring 20 past the nominally closed outlet valve 26 which is located in the vertical connecting duct 19.

A similar arrangement can be used to flush the outlet valves 26. For this, there is another duct ring 28 supported by bracket 29 which, through vertical ducts 32, is coupled to a fan 34 whose input communicates by way of horizontal branch duct 33 with the stack 6. Fan 34 operates to draw out relatively hot purified air from the stack 6 and apply it via elbow 35 to the region just above the outlet valve 26. This fan is required because of the large difference in the pressure existing just above the inlet valve 22 and just above the outlet valve 26. In the former region, the pressure may be −2.5 inches whereas in the other region it may be −5 inches or −11 inches for example. When both the inlet and outlet valves for a particular heat-exchange section 16 are closed, there may be some residual effluent in the space outwardly of the retaining wall 16*b*. By having the region just above valve 26 blanketed with hot purified exhaust, it is this exhaust rather than the effluent which it supplants, which may be drawn through a nominally closed outlet valve 26 into the exhaust ring 20.

Therefore, by using the system described, the bad effects of effluent leaking past inlet valves 22 or outlet valves 26 when nominally closed are considerably mitigated and thus there is considerably less chance that unpurified effluent can get into the exhaust ring 20. To the extent that the hot exhaust air does get pulled down past closed valve 22 or to the extent that the hot air supplied by the elbow 35 does not all leak through nominally closed valve 26, this hot air will pass through the heat-exchange beds into the central combustion chamber. Since it is recycling whatever imperfectly combusted compounds that may exist in the exhaust, those residual compounds will be subjected to a further incineration and purification step. For example, purification might be increased by 1% if approximately 5% of the total flow to the unit is recycled in this valve-blanketing fashion. The recycling of part of the exhaust also helps the thermal efficiency since the purified exhaust is considerably hotter than the usual effluent applied to the apparatus.

As pointed out in the Mueller patent previously alluded to, additional amounts of purified exhaust may be used to purge or flush the spaces in the section 16 outwardly of the retaining wall 16*b* when the inlet and outlet valves 22 and 26 are both supposed to be closed at the same time. Whatever residual effluent may happen to be in that area can be effectively flushed by recycling some of the exhaust into a third duct ring 21 which communicates with stack 6 by way of horizontal duct 25 and with the section 16 by elbows 23 in which valves 24 may be located.

While the invention has been explained in terms of a thermal regeneration system in which there are three or more heat-exchange sections, it could also be applied to other incineration systems for gaseous effluents wherein it is possible for the incoming effluent to by-pass a heat-exchange or combustion chamber through which it normally should pass. In such case, the upstream side of the inlet valve may be blanketed with purified effluent as previously explained.

Still other applications and embodiments of the invention will be apparent to one skilled in the art upon perusal of the specification and drawings herein.

I claim:

1. In incineration apparatus for purifying gaseous effluents or the like which comprises at least one heat-exchange section in communication with a high-temperature combustion chamber, said effluents normally passing through said section and chamber to exhaust, the combination comprising:

a. at least one duct means in communication with selected ones of said sections, said duct means being adapted to convey said effluents, b. at least one valve means in said duct means, and c. means coupled to said duct means and to said exhaust for conveying a predetermined portion of the effluent in said exhaust to blanket a predetermined side of said valve means when said valve means is in a nominally closed position.

2. In the incineration apparatus according to claim 1 wherein said duct means is an inlet duct through which effluents to be purified are conveyed to said selected ones of said sections and wherein said (c) means includes a first duct coupled between said inlet duct on the upstream side of said valve means and said exhaust.

3. In the incineration apparatus according to claim 2 wherein said duct means also includes an outlet duct through which purified effluents flow, said outlet duct being coupled to said exhaust, wherein said (b) means includes another valve means in said outlet duct and wherein said (c) means additionally includes a second duct coupled between said outlet duct on the upstream side of said additional valve means and said exhaust.

4. In the incineration apparatus according to claim 2 wherein there are a plurality of said sections and a corresponding number of said inlet ducts and further wherein said (c) means includes an inlet first duct ring, with which said inlet ducts communicate, said first inlet duct ring being adapted to be coupled to a source of said effluents.

5. In the incineration apparatus according to claim 3 wherein there are a plurality of said sections and a corresponding number of said outlet ducts and further wherein said (c) means includes an outlet duct ring with which said outlet ducts communicate, 6. In the incineration apparatus according to claim 2 or 3 wherein said exhaust comprises a stack and said first and second ducts are also coupled to said stack.

7. In the incineration apparatus according to claim 3 wherein fan means are disposed to impel purified effluent from said exhaust through said second duct to said upstream side of said additional valve means.

8. In the incineration apparatus according to claim 2 or 3 wherein corresponding ends of said first and second ducts are arranged to be in proximity to said upstream sides of said valve.

9. A method of preventing leaks across nominally closed inlet and outlet valves in incineration apparatus for purifying gaseous effluents which normally are conveyed through said valves, a heat-exchange zone and a high temperature combustion zone to exhaust means, comprising the steps of:

(a) obtaining a predetermined portion of said gaseous effluents which have been purified in said combustion zone, and (b) feeding said portion of purified effluents so as to blanket the upstream side of said valve means when they are nominally closed at the same time.

10. The method according to claim 9 wherein said purified effluents are fed to said upstream sides of said inlet and outlet valve means at respectively lower and higher pressures.

11. Effluent purifying apparatus comprising:

a. at least one heat-exchange section, b. a high temperature combustion chamber in communication with one side of said section, c. a flue chamber in communication with the other side of said section, effluents normally being applied to said flue chamber for passage through it into said combustion chamber, d. an inlet duct communicating with said flue chamber and having a first valve therein which is subject to leakage when in a nominally closed position, e. an outlet duct communicating with said flue chamber and having a second valve therein which is subject to leakage when in a nominally closed position, said outlet duct being adapted to be coupled to an exhaust blower so that when both valves are closed, effluents might be sucked past said first and second valves into said outlet duct thereby bypassing said combustion chamber, and f. means for applying gas which has been purified in said combustion chamber to a region in close proximity to the upstream sides of said first and second valves when both are nominally closed thereby substantially minimizing bypass by unpurified effluents of said combustion chamber to exhaust in the atmosphere.

12. The apparatus according to claim 11 wherein said gas-applying means applies said purified gas to said upstream side of said first valve at the pressure of the outlet side of said blower and applies said purified gas to said upstream side of said second valve at a pressure considerably higher than the pressure at the outlet side of said blower.

* * * * *